US011136848B2

(12) United States Patent
Leuchtenberg et al.

(10) Patent No.: US 11,136,848 B2
(45) Date of Patent: Oct. 5, 2021

(54) ROTATING CONTROL DEVICE WITH COOLING MANDREL

(71) Applicant: NTDrill Holdings, LLC, Houston, TX (US)

(72) Inventors: Christian Leuchtenberg, Shamrock Park (SG); Ricardo Gonzalez, Houston, TX (US)

(73) Assignee: NTDrill Holdings, LLC, Houston, TX (US)

( * ) Notice: Subject to any disclaimer, the term of this patent is extended or adjusted under 35 U.S.C. 154(b) by 0 days.

(21) Appl. No.: 16/859,423

(22) Filed: Apr. 27, 2020

(65) Prior Publication Data

US 2020/0340326 A1 Oct. 29, 2020

Related U.S. Application Data

(60) Provisional application No. 62/838,972, filed on Apr. 26, 2019.

(51) Int. Cl.
*E21B 33/08* (2006.01)

(52) U.S. Cl.
CPC ..... *E21B 33/085* (2013.01)

(58) Field of Classification Search
CPC ..... E21B 36/001; E21B 33/085; E21B 47/10; E21B 33/06; E21B 36/00; E21B 4/003
See application file for complete search history.

(56) References Cited

U.S. PATENT DOCUMENTS

| | | | | |
|---|---|---|---|---|
| 3,638,721 | A | 2/1972 | Harrison | |
| 4,143,881 | A | 3/1979 | Bunting | |
| 4,383,577 | A | 5/1983 | Pruitt | |
| 5,279,365 | A | 1/1994 | Yenulis et al. | |
| 5,322,137 | A | 6/1994 | Gonzales | |
| 6,244,359 | B1 | 6/2001 | Bridges et al. | |
| 7,040,394 | B2 * | 5/2006 | Bailey | E21B 33/085 166/84.2 |
| 7,762,320 | B2 | 7/2010 | Williams | |
| 7,836,946 | B2 | 11/2010 | Bailey et al. | |
| 7,870,896 | B1 | 1/2011 | Pruitt et al. | |
| 2015/0315874 | A1 | 11/2015 | Chambers | |
| 2016/0290088 | A1 * | 10/2016 | DeWesee, Jr. | E21B 4/003 |

FOREIGN PATENT DOCUMENTS

| | | | |
|---|---|---|---|
| GB | 2394741 | A | 5/2004 |

* cited by examiner

*Primary Examiner* — James G Sayre
(74) *Attorney, Agent, or Firm* — Young Basile Hanlon & MacFarlane, P.C.

(57) ABSTRACT

A removable cooling mandrel assembly for a rotating control device for use in a drilling system. The present disclosure provides an outer swivel housing enclosing an elongate passage and connected to the uppermost end of an upper housing of the rotating control device. An inner swivel mandrel is mounted in the elongate passage of the outer swivel housing for rotation relative to the outer swivel housing and may be connected to an RCD mandrel of the rotating control device to which the outer swivel housing is connected. A tubular cooling mandrel extends from the inner swivel mandrel out of the outer swivel housing to reduce operating temperatures thereby increasing bearing performance and life and seal life.

20 Claims, 5 Drawing Sheets

ROTATING CONTROL DEVICE WITH COOLING MANDREL

CROSS-REFERENCE TO RELATED APPLICATIONS

This is a non-provisional patent application claiming priority to U.S. Provisional Patent Application Ser. No. 62/838,972, filed Apr. 26, 2019.

FIELD OF INVENTION

This invention relates in general to fluid drilling equipment and in particular to a rotating control device (RCD) to be used for pressurized drilling operations. More specifically, embodiments of the present disclosure relate to a RCD having a cooling mandrel assembly that reduces operating temperature thus increasing bearing performance and life.

In drilling a well, a drilling tool or "drill bit" is rotated under an axial load within a borehole. The drill bit is attached to the bottom of a string of threadably connected tubulars or "drill pipe" located in the borehole. The drill pipe is rotated at the surface of the well by an applied torque which is transferred by the drill pipe to the drill bit. As the borehole is drilled, the hole bored by the drill bit is substantially greater than the diameter of the drill pipe. To assist in lubricating the drill bit, drilling fluid or gas is pumped down the drill pipe. The fluid jets out of the drill bit and flows back up to the surface through the annulus between the wall of the borehole and the drill pipe.

Conventional oilfield drilling typically uses hydrostatic pressure generated by the density of the drilling fluid or mud in the wellbore in addition to the pressure developed by pumping of the fluid to the borehole. However, some fluid reservoirs are considered economically undrillable with these conventional techniques. New and improved techniques, such as underbalanced drilling and managed pressure drilling, have been used successfully throughout the world. Managed pressure drilling is an adaptive drilling process used to more precisely control the annular pressure profile throughout the wellbore. The annular pressure profile is controlled in such a way that the well is either balanced at all times or nearly balanced with a low change in pressure. Underbalanced drilling is drilling with the hydrostatic head of the drilling fluid intentionally designed to be lower than the pressure of the formations being drilled. The hydrostatic head of the fluid may naturally be less than the formation pressure, or it can be induced.

RCDs provide a means of sealing off the annulus around the drill pipe, as the drill pipe rotates and translates axially down the well while including a side outlet through which the return drilling fluid is diverted. Such RCDs may also be referred to as rotating blowout preventers, rotating diverters or drilling heads. These units generally comprise a stationary housing or bowl including a side outlet for connection to a fluid return line and an inlet flange for locating the unit on a blowout preventer (BOP) or other drilling stack at the surface of the wellbore. Within the bowl, opposite the inlet flange, a rotatable assembly provides anti-friction bearings which allow the drill pipe, located through the head, to rotate and slide. The assembly includes a seal onto the drill pipe which is typically made from rubber, polyurethane or another suitable elastomer.

For offshore applications on jack-up drilling rigs or floating drilling rigs, the RCD may be in the form of a cartridge assembly that is latched inside the drilling fluid return riser. In this case, the side outlet may be on a separate spool or outlet on the riser.

The demands made on modern RCDs are pushing the envelope and limit what is achievable with bearings. The trend is for RCDs to be able to provide effective sealing at higher pressures and higher rotational speeds. Advances in the drill string rotation equipment, like top drives used to rotate the drill string and hence the drilling bit, are allowing revolution rates as high as 300 rpm. Rotating at these high revolutions per minute (RPMs), especially at higher operational pressures, causes significant heat output from the bearings. If the bearing operating temperatures are above 88° C. (190 degrees Fahrenheit), the bearing lives tend to be significantly shortened. This problem mainly occurs for land applications where the RCD is deployed above the BOP, and the only heat removal is by radiation and convection with the surrounding air. For offshore applications where the RCD is deployed in the riser under water, there is sufficient improved convection from the seawater surrounding the housing and/or the riser for the temperatures to be within the prescribed norms for bearings.

For land deployed RCDs that are required to operate at higher RPMs and pressure, the main method has been to use oil lubrication for the bearings and at the same time using this oil to cool the bearings. This adds significant additional complexity with having an external oil circulation and cooling system which may in some instances also be pressurized, depending on the design of the RCD to provide pressure support for the seals between the bearing assembly and the wellbore. For the current design envisioned which has significant improvements in terms of sealing that does not require external pressure support, the need for having external pressure supply is gone. Also, for the conditions experienced in RCD applications, the velocity of the bearings is not that high given that the maximum RPM is 300. This coupled with the high bearing load under increasing wellbore pressure makes grease a much more suitable lubricant compared to oil.

A solution is required that allows an RCD to operate with the optimal lubricant, which is bearing grease, while enabling cooling when required as a simple retrofit or add-on system for land applications that envision operations at higher wellbore pressures. This solution is a cooling mandrel that will allow circulation of water or clean drilling fluid past the bearings which can be supplied by a simple low-pressure pump from the drilling rig system.

SUMMARY OF INVENTION

An insertable cooling mandrel may be added to any existing RCD for cooling purposes. The cooling mandrel allows circulation of water or clean drilling fluid directly past the bearing contact surfaces and seal contact surfaces to ensure efficient heat removal.

The present disclosure provides a removable cooling mandrel assembly for a rotating control device for use in a drilling system comprising an outer swivel housing enclosing an elongate passage and having a first connector at a first end thereof by means of which the outer housing may be connected to the uppermost end of an upper housing of the rotating control device. An inner swivel mandrel is mounted in the elongate passage of the outer swivel housing for rotation relative to the outer swivel housing, the inner swivel mandrel having a second connector at a first end thereof by means of which the inner swivel mandrel may be connected to an RCD mandrel of the rotating control device to which the outer swivel housing is connected. The assembly further provides a tubular cooling mandrel which extends from the inner swivel mandrel out of the outer swivel housing at the first end thereof.

The inner swivel mandrel may have an outer surface and a seal assembly to provide a substantially fluid tight seal between the outer surface of the inner swivel mandrel and the outer swivel housing and encloses a passage along which a tubular extending through the elongate passage of the outer swivel housing may pass.

The inner swivel mandrel may have an outer surface and a bearing which engages with the outer swivel housing to support the inner swivel mandrel for rotation relative to the outer swivel housing.

The inner swivel mandrel may be configured such that its connector can connect to an RCD mandrel which has a larger internal diameter than the cooling mandrel and when the inner swivel mandrel is connected to an RCD mandrel the cooling mandrel is arranged so that it is surrounded by the RCD mandrel.

The assembly may further comprise a sealing element which is secured to the inner swivel mandrel for rotation with the inner swivel mandrel and which is configured to seal against a radially outwardly facing surface of a tubular extending along the elongate passage of the outer swivel housing.

The sealing element may be secured to a second end of the inner swivel mandrel.

The sealing element may be configured to seal around a radially outwardly facing surface of a tubular extending along the elongate passage of the outer swivel housing. The assembly may further provide the outer swivel housing having an outlet port which fluidly connects the exterior of the outer swivel housing to a cavity partly enclosed by the sealing element and the inner swivel mandrel via an outlet port provided in the inner swivel mandrel. An outlet hose connector may be mounted on an exterior surface of the outer swivel housing and fluidly connected to the outlet port, wherein the outlet hose connector is configured to facilitate the connection of the outlet port to a hose.

The cooling mandrel of the assembly may be integral with the inner swivel mandrel or may be separate to the inner swivel mandrel so that the cooling mandrel rotates with the inner swivel mandrel.

The assembly may further provide the outer swivel housing with an inlet port fluidly connected to an annular space around the cooling mandrel. The inlet port may be fluidly connected to an annular space between a radially inward facing surface of the inner swivel mandrel and a radially outward facing surface of the cooling mandrel via an inlet port provided in the inner swivel mandrel.

A seal may be provided between the inner mandrel and the end of the cooling mandrel to substantially prevent flow of fluid between the end of the cooling mandrel and the inner swivel mandrel.

The outer swivel housing may be provided with an inlet port which is fluidly connected to an annular space around the cooling mandrel.

The inlet port may be fluidly connected to an annular space between a radially inward facing surface of the first end of the inner swivel mandrel and a radially outward facing surface of the cooling mandrel via an inlet port provided in the inner swivel mandrel.

An inlet hose connector may be mounted on an exterior surface of the outer swivel housing and fluidly connected to the inlet port, the hose connector being configured to facilitate the connection of the inlet port to a hose.

According to a second aspect of the present disclosure provides a rotating control device for use in a drilling system, wherein the rotating control device comprises a non-rotating RCD housing enclosing an elongate passage which extends from a first end of the RCD housing to a second end of the RCD housing. A tubular RCD mandrel which encloses an elongate space and which extends along the elongate passage of the RCD housing having an axis and being configured in use to rotate relative to the RCD housing about the axis, and having a first end and a second end which is closer to the second end of the RCD housing than the first end, a tubular cooling mandrel is connected to the RCD mandrel to rotate with the RCD mandrel, wherein the cooling mandrel has an outer diameter which is smaller than the inner diameter of the RCD mandrel and is arranged to extend within the RCD mandrel, so that the cooling mandrel is surrounded by and spaced from the RCD mandrel to form a cooling annulus between an outer surface of the cooling mandrel and an inner surface of the RCD mandrel.

The rotating control device may further comprise an elastomeric stripper which is mounted on the second end of the RCD mandrel and which is configured to seal against and rotate with a tubular extending along the elongate passage of the RCD housing.

The rotating control device may further comprise a bearing assembly supporting the RCD mandrel for rotation in the RCD housing. An elastomeric stripper element may be mounted to the RCD mandrel and configured to seal against and rotate with a tubular extending along the elongate passage of the RCD housing. A seal assembly may be arranged to isolate the bearing assembly from pressurized fluid in the RCD housing and engage with the RCD mandrel between the stripper element and the bearing assembly.

The cooling mandrel may extend from the first end of the RCD mandrel to a portion of the RCD mandrel between the second end of the RCD mandrel and a portion of the RCD mandrel which engages with the bearing assembly.

The rotating control device may further comprise an inlet port which provides a path for the flow of fluid from the exterior of the rotating control device into the cooling annulus to facilitate pumping of fluid from an external fluid source into the cooling annulus. The inlet port may be located to provide a path for flow of fluid from the exterior of the rotating control device into a first end of the cooling annulus closest to the first end of the RCD mandrel.

The rotating control device may further comprise an outlet port which provides a path for the return flow of fluid from the cooling annulus back to the exterior of the rotating control device. The outlet port may be located to provide a path for flow of fluid from a second end of the cooling annulus closest to the second end of the RCD mandrel.

The rotating control device may further comprise an outer swivel housing enclosing an elongate passage and having a first connector at a first end thereof by means of which the outer swivel housing is secured to the first end of the RCD housing so that the elongate passage of the outer swivel housing forms a continuation of the elongate passage of the RCD housing. An inner swivel mandrel may be mounted in the elongate passage of the outer swivel housing for rotation relative to the outer swivel housing. The inner swivel mandrel may have a second connector at a first end thereof by means of which the inner swivel mandrel is connected to the first end of the RCD mandrel, the cooling mandrel being supported by the inner swivel mandrel.

The inner swivel mandrel may have an outer surface and a seal assembly to provide a substantially fluid tight seal between the outer surface of the inner swivel mandrel and the outer swivel housing and enclose a passage along which a tubular extends along the elongate passage of the RCD housing.

The inner swivel mandrel may have an outer surface and a bearing which engages with the outer swivel housing to support the inner swivel mandrel for rotation relative to the outer swivel housing.

The rotating control device may further comprise a sealing element which is secured to the inner swivel mandrel for rotation with the inner swivel mandrel and which is configured to seal around a radially outwardly facing surface of a tubular extending along the elongate passage of the RCD housing. The sealing element may be secured to a second end of the inner swivel mandrel.

The sealing element may be configured to seal around a radially outwardly facing surface of a tubular extending along the elongate passage of the RCD housing.

The outer swivel housing may be provided with an outlet port which fluidly connects the exterior of the outer swivel housing to a cavity partly enclosed by the sealing element and the inner swivel mandrel via an outlet port provided in the inner swivel mandrel.

An outlet hose connector may be mounted on an exterior surface of the outer swivel housing and fluidly connected to the outlet port, the hose connector being configured to facilitate the connection of the outlet port to a hose.

The cooling mandrel may be integral with the inner swivel mandrel or may be separate to the inner swivel mandrel, and the cooling mandrel secured to the inner swivel mandrel so that the cooling mandrel rotates with the inner swivel mandrel.

A seal may be provided between the inner mandrel and the end of the cooling mandrel to substantially prevent flow of fluid between the end of the cooling mandrel and the inner mandrel.

The outer swivel housing may be provided with an inlet port which is fluidly connected to the cooling annulus adjacent the RCD mandrel. The inlet port may be fluidly connected to the cooling annulus via an annular space between a radially inward facing surface of the inner swivel mandrel and a radially outward facing surface of the cooling mandrel via an inlet port provided in the inner swivel mandrel.

An inlet hose connector may be mounted on an exterior surface of the outer swivel housing and fluidly connected to the inlet port, the hose connector being configured to facilitate the connection of the inlet port to a hose.

The outer surface of the cooling mandrel may be provided with at least one guide which extends radially from the outer surface of the cooling mandrel into the cooling annulus to change the direction of fluid flowing in the cooling annulus generally parallel to the axis of the RCD mandrel.

Each guide may extend from the outer surface of the cooling mandrel to engage with the inner surface of the RCD mandrel.

The rotating control device may further comprise a bearing assembly which supports the RCD mandrel for rotation in the RCD housing, an elastomeric stripper element which is mounted on the second end of the RCD mandrel and which is configured to seal against and rotate with a tubular extending along the elongate passage of the RCD housing, and a seal assembly which is arranged to isolate the bearing assembly from pressurized fluid in the RCD housing, and which engages with the RCD mandrel between the stripper element and the bearing assembly, wherein the guide or at least one of the guides is aligned with a portion of the RCD mandrel which engages with the bearing assembly.

According to a third aspect of the invention, the present disclosure provides a drilling system comprising a rotating control device according to the second aspect of the invention, a drill string extending along the elongate passage of the RCD housing, a cooling fluid reservoir and a pump operable to pump cooling fluid from the cooling fluid reservoir into the cooling annulus.

According to a fourth aspect of the invention, the present disclosure provides a method of operating a drilling system according to the third aspect of the invention comprising pumping cooling fluid from the cooling fluid reservoir into the cooling annulus whilst rotating the drill string about an axis generally parallel to the elongate passage of the RCD housing.

BRIEF DESCRIPTION OF DRAWINGS

For a more complete understanding of the present disclosure, and the advantages thereof, reference is now made to the following descriptions taken in conjunction with the accompanying drawings, in which.

DETAILED DESCRIPTION OF THE INVENTIONS

The present disclosure is best understood by referring to FIGS. 1-5 of the drawings, in which like numbers designate like parts.

Figure 1:
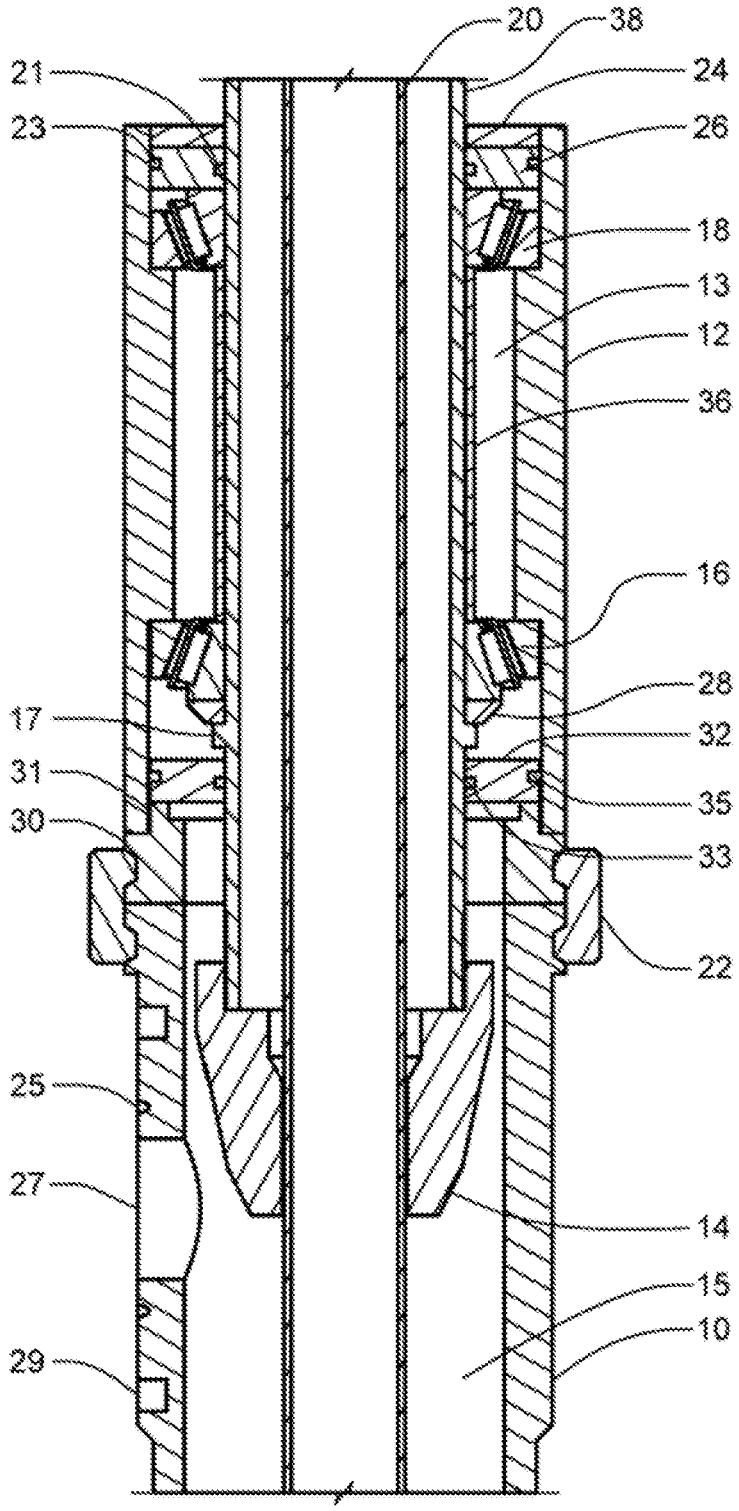
FIG. 1 (PRIOR ART)
FIG. 1 is a cross-sectional view of a prior art rotating control device.

FIG. 1 is a schematic cross section of a typical prior art rotating control device (RCD) which will serve to illustrate the common current methods of achieving sealing. The RCD has a housing which encloses an elongate passage which extends along a longitudinal axis from a first end of the RCD housing to a second end of the RCD housing. In this example, the RCD housing comprises an upper housing 12 and a lower housing 10, wherein the upper housing 12 has an adapter 30 with threads 31 to enable a clamp 22 to connect the upper housing 12 to the lower housing 10. This is a common arrangement for land RCDs. The assembly may be in one piece and latched into a drilling riser (not shown) below a slip joint (not shown) for a floating drilling rig (not shown) or latched into a diverter (not shown) just above a blowout preventer (BOP) on a jack-up drilling rig (not shown). A tubular, which in this embodiment may be a drill pipe 20, extends through the RCD assembly substantially co-axial with the longitudinal axis and is sealed with a stripper element or stripper rubber 14 attached to a RCD mandrel 38 which is also substantially co-axial to the longitudinal axis. The RCD mandrel 38 is located in the elongate passage in the RCD housing, and has a first end, and a second end which is closer to the second end of the RCD housing (in this example the lowermost end of the lower RCD housing 10) than the first end of the RCD mandrel 38 is. There is a side outlet 27 with a seal groove 25 and stud holes 29 for bolting on a side outlet adapter (not shown). The pressure load from the stripper element 14, due to pressure in a wellbore cavity 15 when drilling with pressure, is transmitted via a load shoulder 17 on the RCD mandrel 38 via a spacer ring 28. The load is transferred to a bearing assembly, which supports the RCD mandrel 38 for rotation in the upper RCD housing 12. In this embodiment, the bearing assembly comprises two sets of conical roller bearings, a lower roller bearing 16 and an upper roller bearing 18, separated by a spacer sleeve 36. The RCD mandrel 38 is free to rotate, as the drill pipe 20 rotates and frictionally transmits the torque through the stripper element 14 and transmits this rotation to the RCE mandrel 38. The upper part of the upper housing 12 has a retention plate 24 with an upper seal carrier 26 below the retention plate 24 which is sealed with a static seal 23 to the upper housing 12. A dynamic seal 21 seals a bearing cavity 13 from the outside environment. The dynamic seal 21 may be a sealing system consisting of multiple seals, like an excluder seal and a dynamic seal. A similar lower seal carrier 32 seals the bearing cavity 13 against the wellbore pressure in the wellbore cavity 15. Similar to the upper seal carrier 26, the lower seal carrier 32 has a similar static seal 35 and a dynamic seal assembly 33 which can have one or more seals. The exact embodiment depends on the design of the RCD, and whether there is a pressurized oil supply to the bearing cavity 13, as this is a common method for cooling and lubricating bearings.

Figure 2:
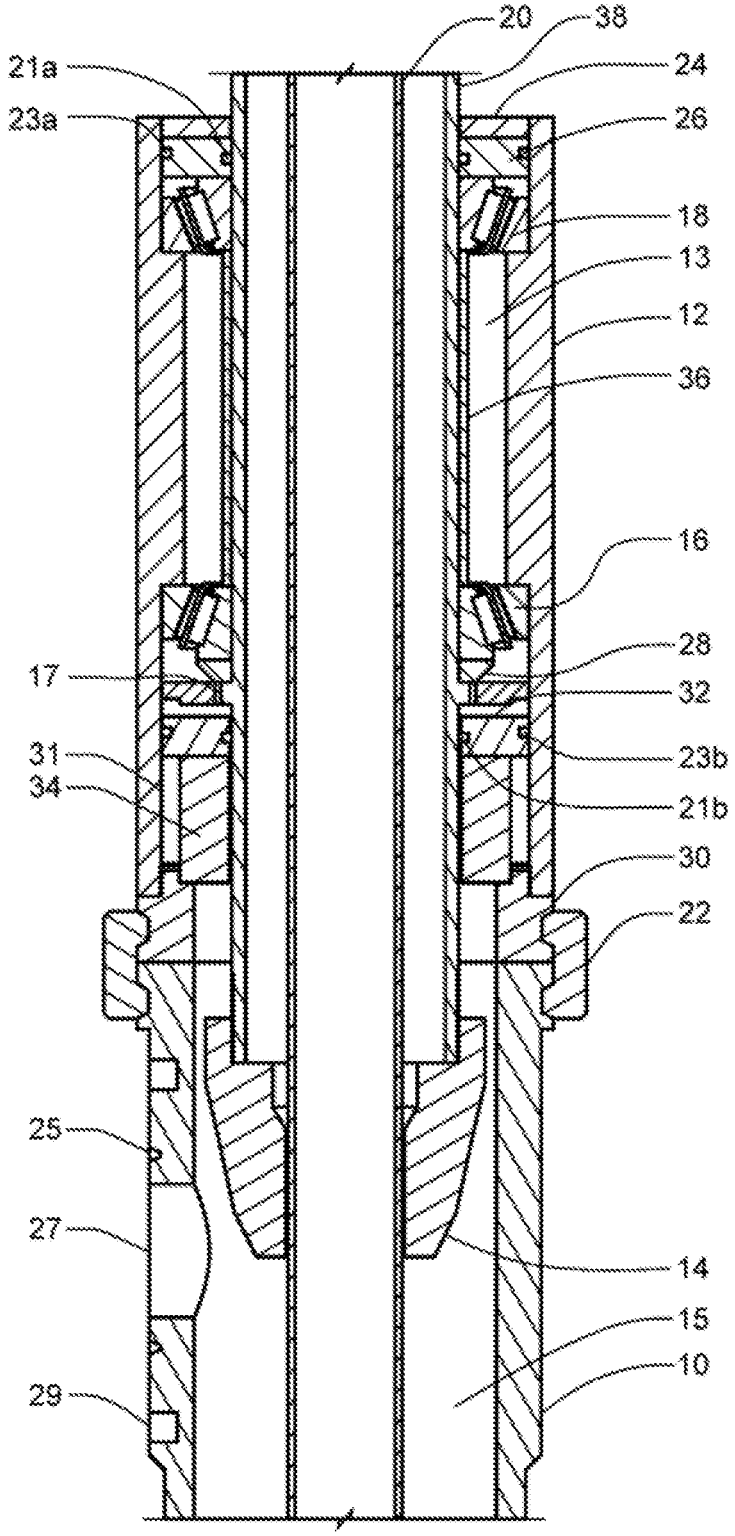
FIG. 2 is cross-sectional view of a rotating control device showing the location of a seal of the present disclosure.

FIG. 2 shows a seal assembly 34 implemented within the RCD and schematically positioned just below the lower seal carrier 32. This seal assembly 34 can be a mechanical seal as described in U.S. formal patent application Ser. No. 16/709,997 or a multiple lip seal assembly as described in U.S. formal patent application Ser. No. 16/744,258, wherein such disclosures are fully incorporated by reference. It is the intent of this disclosure that the seal assembly 34 takes the full pressure differential from the wellbore cavity 15 to the external environment with no pressure staging in the bearing cavity 13. As such, dynamic seals 21*a* and 21*b* on the upper seal carrier 26 and the lower seal carrier 32 will be the same, as the dynamic seals 21*a* and 21*b* are not sealing any pressure differential. Outer static seals 23*a* and 23*b* will also be the same. This allows for a much simpler design of the RCD, as the need for complex PV reduction strategies is removed.

The mechanical seal or the multiple lip seal of the seal assembly 34 will generate significant heat when operated under a high load i.e. high wellbore pressure conditions and high RPM of the drillstring. This will also generate significant heat from the bearings 16 and 18. The disclosure is a removable cooling mandrel and cooling system that can be retrofitted to any common RCD assembly.

Figure 3:
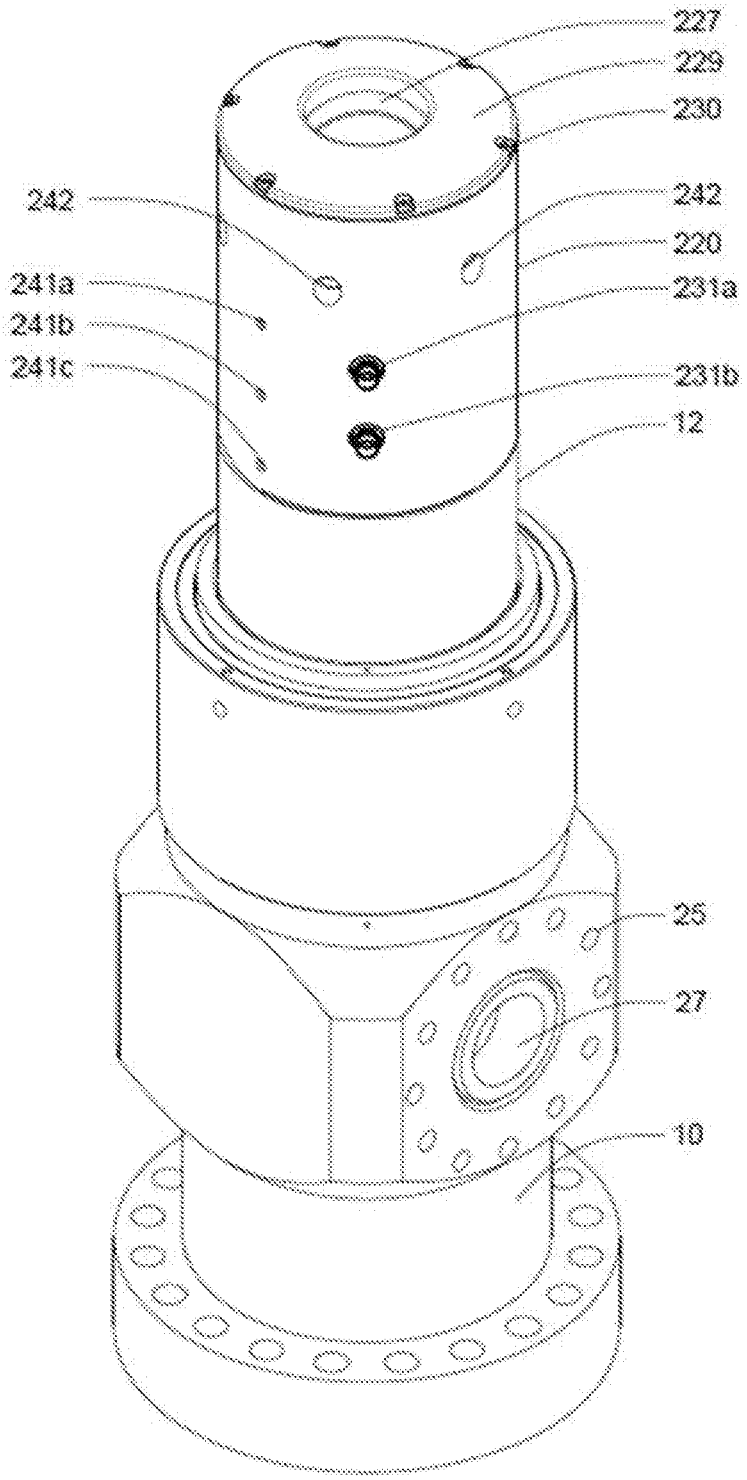
FIG. 3 is an isometric view of the proposed cooling embodiment of the present disclosure.

FIG. 3 shows an external view of the RCD assembly having an outer swivel housing 220 and a first end of which is connected to the first end of the original upper housing 12 by means of a first connector. The outer swivel housing 220 encloses an elongate passage along which the drill pipe 20 extends and has various externally visible components that are described in detail in FIG. 4.

Figure 4:
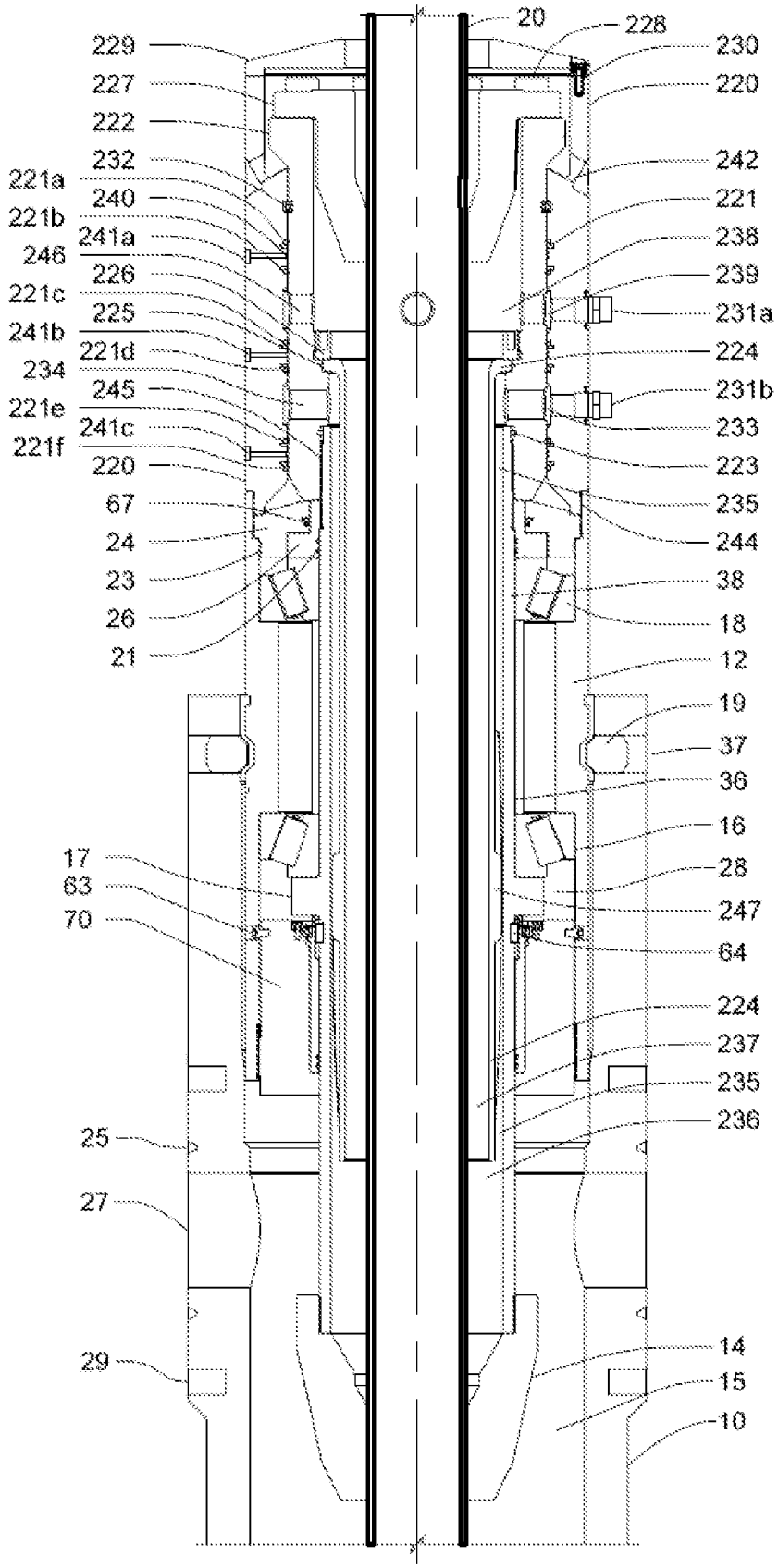
FIG. 4 is a schematic cross section of the proposed cooling embodiment of the present disclosure.

FIG. 4 shows a schematic cross-section that has like parts with FIG. 2 labelled the same. The seal assembly 34 as shown in FIG. 2 is shown in FIG. 4 as a multiple seal cartridge 70 (details not shown). The rotating part of the seal cartridge 70 is secured to the RCD mandrel 38 with a key 64, and the outer part of the seal cartridge 70 is locked to the upper housing 12 by anti-rotation bolts 63. A cooling mandrel 224, having an outer diameter which is smaller than the inner diameter of the RCD mandrel 38, is inserted inside the RCD mandrel 38 and is substantially co-axial with the longitudinal axis thereby creating an annular fluid path 235 between the outer surface of the cooling mandrel 224 and the inner surface of the RCD mandrel 38. An inlet port, which in this embodiment is provided with a hose connector 231*b*, allows a cooling fluid (not shown) to enter into a circumferential fluid annulus 233 from where the cooling fluid flows through multiple ports 234 into the annular fluid path 235. In this embodiment, the inlet port is located so as to provide a path for flow of fluid from the exterior of the RCD into a first end of the fluid path 235 closest to the first end of the RCD mandrel 38. The cooling fluid is supplied under pressure from a simple low-pressure diaphragm pump or centrifugal pump (not shown) taking clean drilling fluid or water from the drilling rig mud system (not shown). The cooling fluid flows down the fluid path 235 from the first end of the fluid path 235, cooling the bearings 16 and 18, then cooling the seal cartridge 70, finally to a second end of the fluid path 235 closest to the second end of the RCD mandrel 38, exiting at a cavity 236 below the cooling mandrel 224 and then flowing up along an annular cavity 237 defined between the drill pipe 20 and the RCD mandrel 38 as the bottom of the cavity 236 is sealed by the stripper element 14 between the RCD mandrel 38 and the drill pipe 20.

The cooling fluid now having warmed up with heat from the bearings 16 and 18 and the seal cartridge 70 is now in contact with the drill pipe 20 which will have cool drilling fluid circulating downwards when drilling will induce cooling of the cooling fluid through heat exchange.

An inner swivel mandrel 222 is located in the elongate passage of the outer swivel housing 220 and encloses a cavity 238 above the cooling mandrel 224. The cavity 238 is closed by a low-pressure stripper rubber 227 which extends from the inner swivel mandrel 222 and seals around the drill pipe 20.

The cooling fluid travels up and exits into the cavity 238. The cooling fluid then exits through exit ports 246 provided in the inner swivel mandrel 222 into a fluid annulus 239 between a radially outwardly facing surface of the inner swivel mandrel 222 and the internal surface of the outer swivel housing 220, and then through an outlet port in the outer swivel housing 220. The outlet port in the outer swivel housing 220 is provided with a hose connector 231*a* and may be fitted with a hose (not shown) to direct the returning cooling fluid back to the drilling rig. The cooling fluid, having been cooled somewhat by the heat exchange with the drill pipe 20, can be routed back to a tank (not shown) used to supply the cooling fluid. Such tanks are typically large on a drilling rig thereby holding several thousands of gallons of cooling fluid which means that this volume of cooling fluid will heat up slowly. Alternatively, the cooling fluid could be routed to a dedicated water tank (not shown) which could be smaller and have additional coolers like a radiator (not shown).

Obviously, the supply of cooling fluid to and from the RCD mandrel 38 requires a swivel mechanism and a seal which are now explained. The top of the original RCD upper housing 12 has a seal retention plate 24 with a lip seal 67 towards the upper seal carrier 26 which is threaded and rotates with the rotating RCD mandrel 38. The upper housing 12 is slightly modified with a threaded extension 244 enabling the outer swivel housing 220 to be mounted on top of the upper housing 12 (the first end of the RCD housing) and connected thereto by means of the first connector, which in this embodiment is a correspondingly threaded portion at the first (lowermost) end of the outer swivel housing 220.

Whilst the cooling mandrel 224 may be integral with the inner swivel mandrel 222, in this embodiment, the cooling mandrel 224 and the inner swivel mandrel 222 are separate, an end of the cooling mandrel 224 being connected to the inner swivel mandrel 222 so that the cooling mandrel 224 rotates with the inner swivel mandrel 222. In this embodiment, the cooling mandrel 224 is held in place by a threaded retainer ring 226 and sealed with a seal 225, which fixes the cooling mandrel 224 to the inner swivel mandrel 222, a first end of which is turn is connected to the first end of the RCD mandrel 38 by a second connector which in this example is an inner swivel mandrel thread 245, and sealed with a seal 223. As such, it will be appreciated that the cooling mandrel 224 rotates with the RCD mandrel 38 and the drill pipe 20.

The sealing between the inner swivel mandrel 222 and the outer swivel housing 220 is achieved by multiple lip seals 221*a*-221*f* which are paired between required pressure isolation points with weep ports 241*a*-241*c* to enable detection of any leaks. An annular groove 240 between the lip seals 221*a* and 221*b* allows communication to the weep ports 241*a*-241*c*. Similar annular grooves are present for the other pairs of lip seals 221*c*-221*f*. The inner swivel mandrel 222, being rigidly affixed to the RCD mandrel 38, is centered by the RCD bearings 16 and 18. In this embodiment, an additional bearing 232 is placed between the inner swivel mandrel 222 and the outer swivel housing 220 to keep the required gap for optimal performance of the lip seals 221.

The low-pressure stripper rubber 227 is much softer than the main stripper element 14, as the main purpose of the low-pressure stripper rubber 227 is to provide low pressure isolation for the cooling fluid. The low-pressure stripper rubber 227 is retained by bolts 228 onto the inner swivel mandrel 222 and as such, rotates at the same RPM with the drill pipe 20 and the RCD mandrel 38. An annular protective plate 229 is attached to the uppermost end of the outer swivel housing 220 with bolts 230 and serves to protect the low-pressure stripper rubber 227 whilst providing a central aperture through which the drill pipe 20 passes. Any accumulation of mud or drilling fluids can escape through a port 242.

Figure 5:
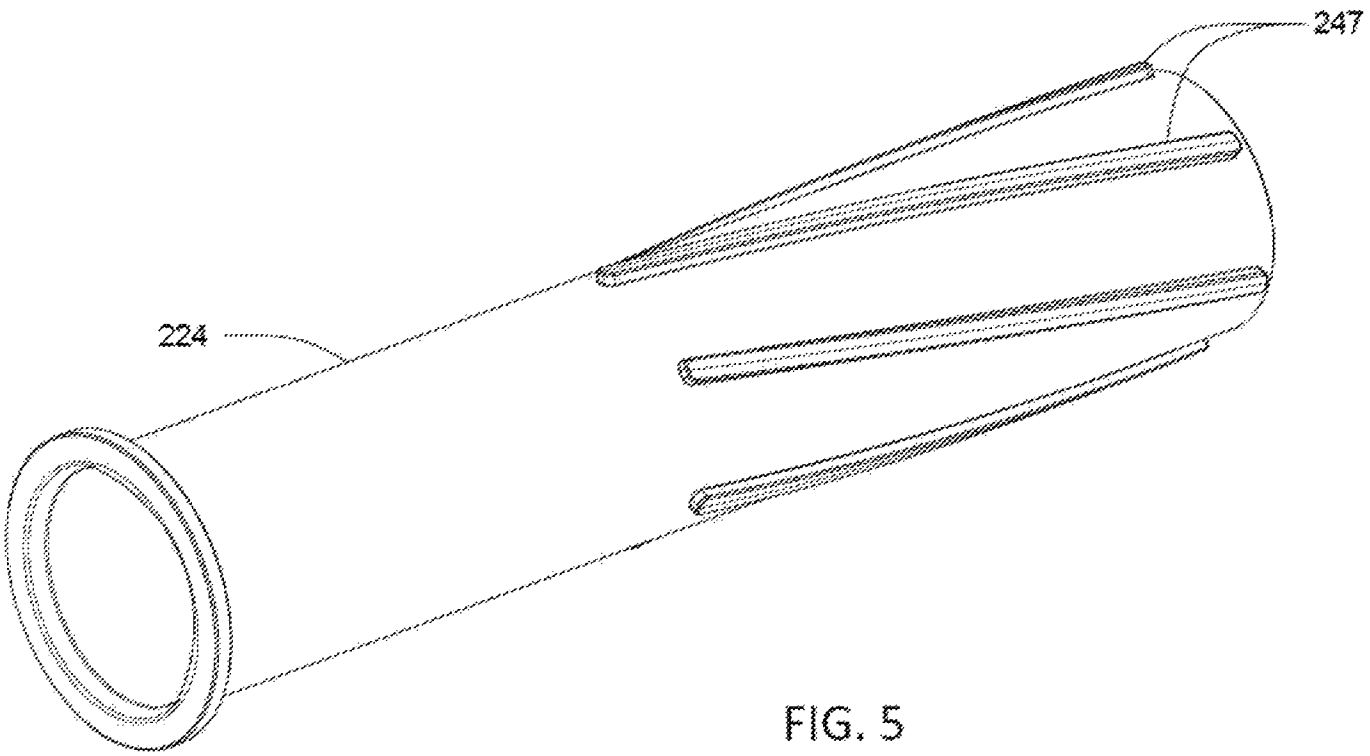
FIG. 5 is an isometric view of the inner cooling mandrel of the present disclosure.

FIG. 5 shows the cooling mandrel 224 with multiple guides 247 which serve to maintain a constant annular gap with the RCD mandrel 38 and also to guide the cooling fluid flow by evenly distributing the cooling fluid as illustrated by the fluting and spiral formation of the guides 247. This can be optimized based on the flow required and the identification of main hot spots, like bearing contact points with the RCD mandrel 38. As such there can be multiple sets of flutes and spacers to improve the efficiency of the cooling path.

Although the present disclosure has been described with reference to specific embodiments, these descriptions are not meant to be construed in a limiting sense. Various modifications of the disclosed embodiments, as well as alternative embodiments of the present disclosure, will become apparent to persons skilled in the art upon reference to the description of the present disclosure. It should be appreciated by those skilled in the art that the conception and the specific embodiment disclosed might be readily utilized as a basis for modifying or designing other structures for carrying out the same purposes of the present disclosure. It should also be realized by those skilled in the art that such equivalent constructions do not depart from the spirit and scope of the present disclosure as set forth in the appended claims.

It is therefore contemplated that the present disclosure will cover any such modifications or embodiments that fall within the scope of the claims.

What is claimed is:

1. A removable cooling mandrel assembly for a rotating control device for use in a drilling system comprising:

an outer swivel housing enclosing an elongate passage and having a first connector at a first end thereof by means of which the outer housing may be secured to the uppermost end of an upper housing of a rotating control device;

an inner swivel mandrel mounted in the elongate passage of the outer swivel housing for rotation relative to the outer swivel housing, the inner mandrel having a second connector at a first end thereof by means of which the inner mandrel may be connected to an RCD mandrel of the rotating control device to which the outer swivel housing is connected; and a tubular cooling mandrel which extends from the inner swivel mandrel out of the outer swivel housing at the first end thereof.

2. The assembly according to claim 1, wherein the inner swivel mandrel has an outer surface and a seal assembly to provide a substantially fluid tight seal between the outer surface of the inner swivel mandrel and the outer swivel housing and encloses a passage along which a tubular extending through the elongate passage of the outer swivel housing may pass.

3. The assembly according to claim 1, wherein the inner swivel mandrel has an outer surface and a bearing which engages with the outer swivel housing to support the inner swivel mandrel for rotation relative to the outer swivel housing.

4. The assembly according to claim 1, further comprising:

a sealing element which is secured to the inner swivel mandrel for rotation with the inner swivel mandrel and which is configured to seal against a radially outwardly facing surface of a tubular extending along the elongate passage of the outer swivel housing.

5. The assembly according to claim 1, wherein the outer swivel housing is provided with an outlet port which fluidly connects the exterior of the outer swivel housing to a cavity partly enclosed by the sealing element and the inner swivel mandrel via an outlet port provided in the inner swivel mandrel, and an outlet hose connector is mounted on an exterior surface of the outer swivel housing and fluidly connected to the outlet port, the hose connector being configured to facilitate the connection of the outlet port to a hose.

6. The assembly according to claim 1, wherein the cooling mandrel is either integral with the inner swivel mandrel or separate to the inner swivel mandrel and connected to the inner mandrel so that the cooling mandrel rotates with the inner swivel mandrel.

7. The assembly according to claim 1, wherein the outer swivel housing is provided with an inlet port which is fluidly connected to an annular space around the cooling mandrel, and the inlet port is fluidly connected to an annular space between a radially inward facing surface of the first end of the inner swivel mandrel and a radially outward facing surface of the cooling mandrel via an inlet port provided in the inner swivel mandrel.

8. A rotating control device for use in a drilling system, the rotating control device comprising:

a non-rotating RCD housing enclosing an elongate passage which extends from a first end of the RCD housing to a second end of the RCD housing;

a tubular RCD mandrel which encloses an elongate space whose diameter is equal to an internal diameter of the RCD mandrel and which extends along the elongate passage of the RCD housing, the RCD mandrel having an axis and being configured in use to rotate relative to the RCD housing about said axis, and having a first end and a second end which is closer to the second end of the RCD housing than the first end; and a tubular cooling mandrel which is connected to the RCD mandrel to rotate with the RCD mandrel, the cooling mandrel having an outer diameter which is smaller than an inner diameter of the RCD mandrel and being arranged to extend within the RCD mandrel, so that the cooling mandrel is surrounded by and spaced from the RCD mandrel to form a cooling annulus between an outer surface of the cooling mandrel and an inner surface of the RCD mandrel.

9. A rotating control device according to claim 8, further comprising:

a bearing assembly supporting the RCD mandrel for rotation in the RCD housing;

an elastomeric stripper element which is mounted to the RCD mandrel and which is configured to seal against and rotate with a tubular extending along the elongate passage of the RCD housing; and a seal assembly arranged to isolate the bearing assembly from pressurized fluid in the RCD housing, and which engages with the RCD mandrel between the stripper element and the bearing assembly.

10. The rotating control device of claim 8, further comprising:

an inlet port which provides a path for flow of fluid from the exterior of the rotating control device into the cooling annulus to facilitate pumping of fluid from an external fluid source into the cooling annulus, the inlet port being located to provide a path for flow of fluid from the exterior of the rotating control device into a first end of the cooling annulus closest to the first end of the RCD mandrel.

11. The rotating control device of claim 8, further comprising:

an outlet port which provides a path for return flow of fluid from the cooling annulus back to the exterior of the rotating control device, the outlet port being located to provide a path for flow of fluid from a second end of the cooling annulus closest to the second end of the RCD mandrel.

12. The rotating control device according to claim, 8 further comprising:

an outer swivel housing enclosing an elongate passage and having a first connector at a first end thereof by means of which the outer swivel housing is secured to the first end of the RCD housing so that the elongate passage of the outer swivel housing forms a continuation of the elongate passage of the RCD housing; and an inner swivel mandrel which is mounted in the elongate passage of the outer swivel housing for rotation relative to the outer swivel housing, the inner swivel mandrel having a second connector at a first end thereof by means of which the inner mandrel is connected to the first end of the RCD mandrel, and the cooling mandrel supported by the inner swivel mandrel.

13. The rotating control device of claim 12, wherein the inner swivel mandrel has an outer surface and a seal assembly to provide a substantially fluid tight seal between the outer surface of the inner swivel mandrel and the outer swivel housing and encloses a passage along which a tubular extends along the elongate passage of the RCD housing.

14. The rotating control device of claim 12, wherein the inner swivel mandrel has an outer surface and a bearing which engages with the outer swivel housing to support the inner swivel mandrel for rotation relative to the outer swivel housing.

15. The rotating control device of claim 12, further comprising:

a sealing element which is secured to the inner swivel mandrel for rotation with the inner swivel mandrel and which is configured to seal around a radially outwardly facing surface of a tubular extending along the elongate passage of the RCD housing, wherein the sealing element is secured to the inner swivel mandrel.

16. The rotating control device of claim 15, wherein the outer swivel housing is provided with an outlet port which fluidly connects the exterior of the outer swivel housing to a cavity partly enclosed by the sealing element and the inner swivel mandrel via an outlet port provided in the inner swivel mandrel.

17. The rotating control device of claim 12, wherein the outer swivel housing is provided with an inlet port which is fluidly connected to a first end of the cooling annulus adjacent the first end of the RCD mandrel, and the inlet port is fluidly connected to the cooling annulus via an annular space between a radially inward facing surface of the first end of the inner swivel mandrel and a radially outward facing surface of the cooling mandrel via an inlet port provided in the inner swivel mandrel.

18. The rotating control device of claim 8, wherein the cooling mandrel is either integral with the inner swivel mandrel or separate from the inner swivel mandrel and connected to the inner swivel mandrel so that the cooling mandrel rotates with the inner swivel mandrel.

19. The rotating control device of claim 8, wherein the outer surface of the cooling mandrel is provided with at least one guide which extends radially from the outer surface of the cooling mandrel into the cooling annulus to change the direction of fluid flowing in the cooling annulus generally parallel to the axis of the RCD mandrel.

20. A drilling system comprising a rotating control device, the rotating control device comprising:

a non-rotating RCD housing enclosing an elongate passage which extends from a first end of the RCD housing to a second end of the RCD housing;

a tubular RCD mandrel which encloses an elongate space whose diameter is equal to an internal diameter of the RCD mandrel and which extends along the elongate passage of the RCD housing, the RCD mandrel having an axis and being configured in use to rotate relative to the RCD housing about said axis, and having a first end and a second end which is closer to the second end of the RCD housing than the first end; and a tubular cooling mandrel which is connected to the RCD mandrel to rotate with the RCD mandrel, the cooling mandrel having an outer diameter which is smaller than the inner diameter of the RCD mandrel and being arranged to extend within the RCD mandrel, so that the cooling mandrel is surrounded by and spaced from the RCD mandrel to form a cooling annulus between an outer surface of the cooling mandrel and an inner surface of the RCD mandrel, wherein the drilling system further comprises a drill string extending along the elongate passage of the RCD housing, a cooling fluid reservoir and a pump operable to pump cooling fluid from the cooling fluid reservoir into the cooling annulus.

* * * * *